United States Patent [19]

Niemand

[11] Patent Number: 4,744,735

[45] Date of Patent: May 17, 1988

[54] PARALLEL-CYLINDER, ANGLED-VALVE FLUID PUMP

[76] Inventor: Geoffrey S. Niemand, Plot 18, Eikenhof, Transvaal, South Africa

[21] Appl. No.: 921,605

[22] Filed: Oct. 20, 1986

[30] Foreign Application Priority Data

Oct. 21, 1985 [ZA] South Africa ..... 85/8073

[51] Int. Cl.[4] ..... F04B 21/02

[52] U.S. Cl. ..... 417/533; 417/454; 417/501; 417/539; 417/569

[58] Field of Search ..... 417/339, 342, 533, 539, 417/507, 569, 571, 454, 559

[56] References Cited

U.S. PATENT DOCUMENTS

| | | | |
|---|---|---|---|
| 1,325,398 | 12/1919 | Ellingson | 417/539 |
| 3,327,641 | 6/1967 | Klosterman | 417/342 X |
| 4,527,961 | 7/1985 | Redwine et al. | 417/454 |

*Primary Examiner*—Leonard E. Smith

*Attorney, Agent, or Firm*—Ladas & Parry

[57] ABSTRACT

A dual cylinder hydraulically operated pump for viscous materials is described. The pump comprises a pair of pistons reciprocable in parallel cylinders opening into a common inlet and outlet housing in which the outlet valve seats are angled with respect to the principal cylinder axes and the inlet valve seat are angled with respect to the cylinder plane, that is the plane extending between the cylinder center lines.

21 Claims, 6 Drawing Sheets

PARALLEL-CYLINDER, ANGLED-VALVE FLUID PUMP

BACKGROUND OF THE INVENTION

This invention relates to a fluid pump and in particular to a dual cylinder hydraulically operated pump for viscous materials.

Known dual cylinder pumps, in which a pair of pistons are reciprocally mounted in a pair of adjacent, parallel cylinders, have common inlet and outlet housings in which hydraulically actuated inlet and outlet valves operate. In these pumps, the inlet valves, which operate at right angles to the pump cylinder axes, are mounted on a hinged actuator sub-frame which can be swung clear of the common inlet and outlet housing. The outlet valves operate along axes parallel to the pump cylinder axes and are carried on a hinged outlet branch assembly which, in turn, can be swung clear of the common inlet and outlet housing for maintenance purposes.

This pump suffers from the disadvantage that it requires disconnection of either the feed or discharge line to enable maintenance work to be carried out on the valves. The known pumps also suffer from the disadvantage that the spacing apart of the cylinders results in a relatively complex flow pattern through the discharge line of the pump which, in turn, results in higher operating pressures and power requirements.

SUMMARY OF THE INVENTION

A fluid pump comprises a pair of pistons reciprocable in parallel cylinders opening into a common outlet through cylinder outlets surrounded by outlet valve seats, the cylinders being closable by outlet valves closing against the outlet valve seats which are angled with respect to the principal cylinder axes.

The pump may be provided with a common inlet and outlet housing including inlet apertures surrounded by inlet valve seats opening into the housing, the inlet apertures being closable by inlet valves and the inlet valve seats being angled with respect to the cylinder plane, that is the plane extending between the cylinder centre lines.

It is most convenient to use fluid actuated lift valves operating on axes normal to the planes of the valve seats for both the inlet and outlet valves with the result that the valve actuator axes are angled, with respect to the cylinder axes on the outlets, and, on the inlets, with respect to the principal pump plane, that is a plane normal to the cylinder plane and extending between the cylinder centre lines.

The angular disposition of the valves enables the location of the cylinders closely adjacent one another. In fact, in the preferred form of the invention the cylinders share a common dividing wall and the common inlet and outlet housing extends virtually in a straight line from the cylinder outlet to the discharge outlet of the pump.

The outlet valve seat may extend along a plane angled between 0° and 90° to the principal axis of each cylinder. In the preferred form of the invention the outlet valve seat planes extend at an angle of 35° to the principal axis of each cylinder.

Likewise the inlet valve seats may extend along planes angled between 0° and −90° to the principal pump plane and in the preferred form of the invention extend at an angle of −35° to the principal pump plane.

The valve assemblies, comprising valve disc, stem and actuator are preferably removably mounted on the valve mounting apertures which are sufficiently large to allow withdrawl of the valve closure discs from the outside of the pump.

The inlet and outlet housing may be divided into inlet and outlet parts which are separable from one another.

BRIEF DESCRIPTION OF THE DRAWINGS

The invention will be further described with reference to the accompanying drawings in which.

DESCRIPTION OF AN EMBODIMENT OF THE INVENTION

Figure 1:
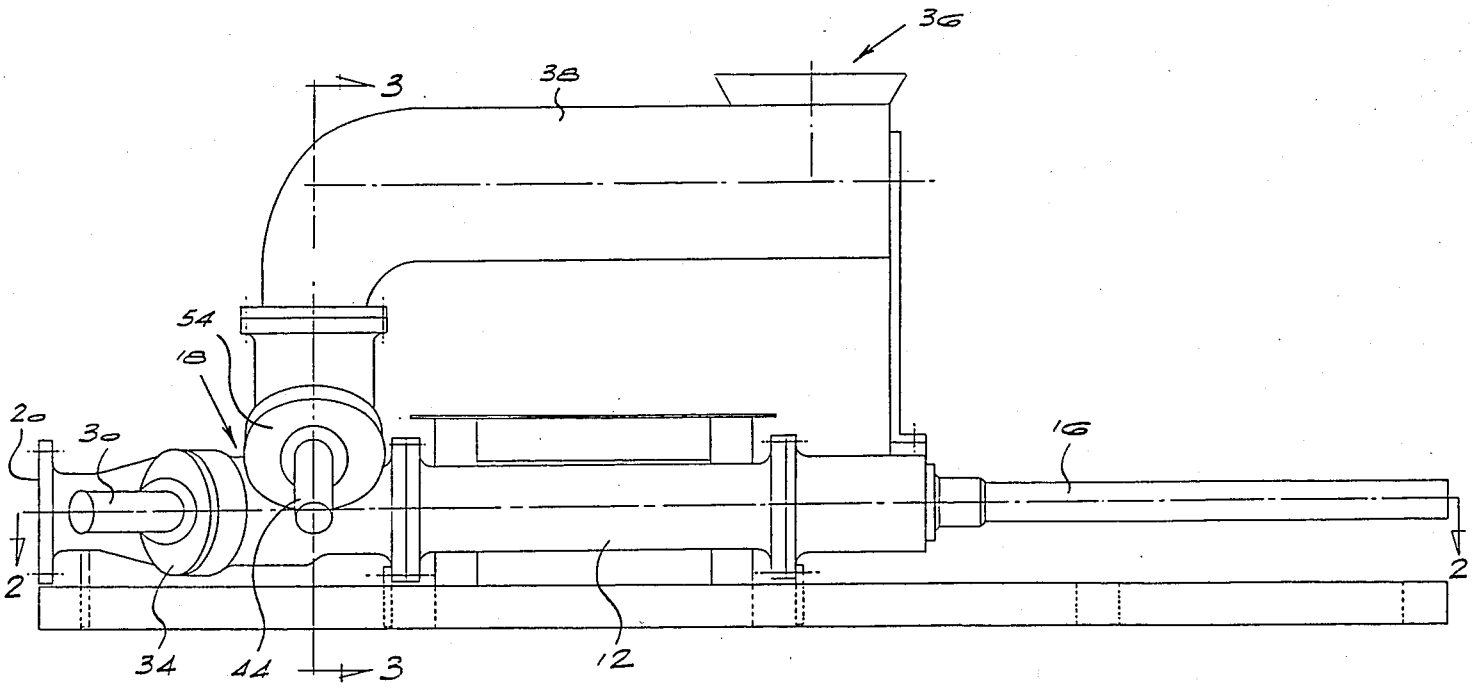
FIG. 1 is a diagramatic side elevation of a pump according to the invention.
Figure 2:
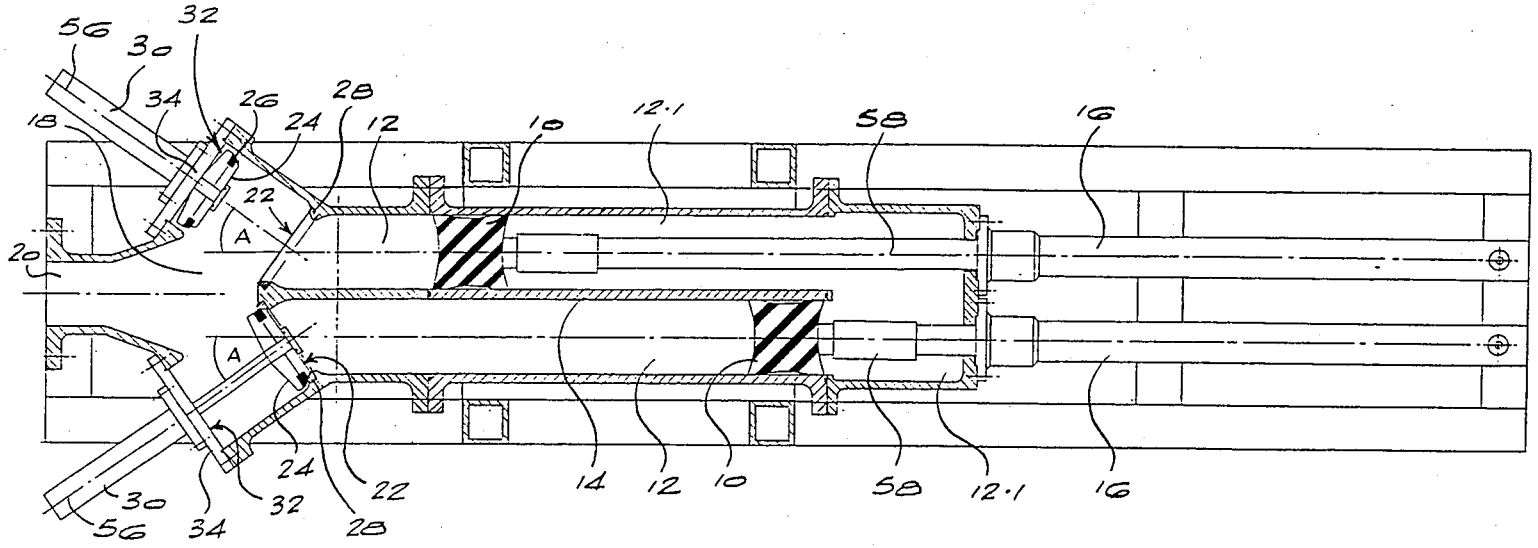
FIG. 2 is a plan view on a line 2—2 in FIG. 1.
Figure 3:
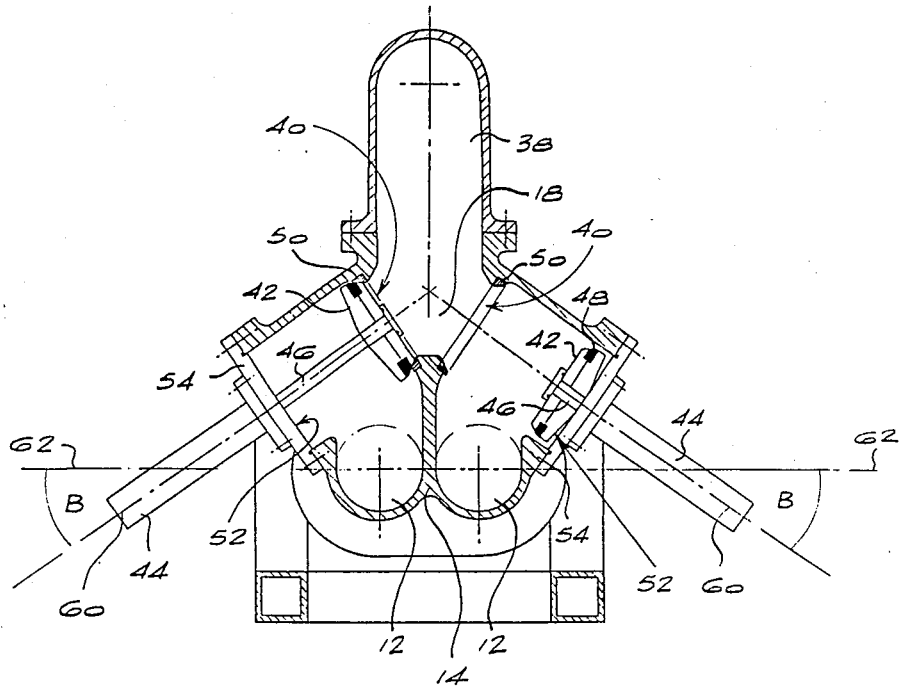
FIG. 3 is a sectional end elevation on a line 3—3 in FIG. 1.

In FIGS. 1 to 3 a dual cylinder pump for viscous fluids is shown to include a pair of pistons 10 reciprocally mounted in a pair of cylinders 12 which share a common dividing wall 14. The area 12.1 to the rear of the pistons 10 in the cylinders 12, is filled with a so-called water bath in which water, which is replenished from time to time, cleans the cylinder walls and lubricates the pistons 10. The pistons 10 are actuated by means of hydraulic actuators 16.

The cylinders 12 open into a common inlet and outlet housing 18 which feeds directly into the discharge line 20 of the pump. Each cylinder outlet 22 is closable by means of a lift valve disk 24 provided with an elastomeric seal 26 which seals against a water resistant valve seat liner 28.

The valves are hydraulically actuated by means of hydraulic actuators 30 and are mounted on valve mounting openings 32 by means of cover plates 34 which close the openings 32.

On the inlet side, the fluid to be pumped is fed from a hopper at 36 and enters the common inlet and outlet housing 18 through an inlet line 38 which is seen in cross-section in FIG. 3. The inlet line discharge openings 40 are closed by lift valve discs 42 of inlet valves which are identical to the outlet valves described above in that they comprise hydraulic actuators 44, valve stems 46 and elastomeric seals 48 and they close against wear resistant valve seat liners 50. The inlet valves are mounted on valve mounting apertures 52 by means of cover plates 54. The valves and valve seat liners of the pump are identical and freely interchangeable which, it will be appreciated, has practical advantages as far as pump maintenance is concerned.

In operation the pistons 10 reciprocate in sequence in the cylinders 12 with the valves opening and closing in sequence. As can be seen from FIGS. 2, 3 and 7, a plane 61, the cylinder plane, extends between the cylinder centre lines 58. The outlet valves (designated by OV in FIG. 7) are mounted on actuator operating axes 56 which are angled, at an angle A, with respect to the principal cylinder axes 58 which, in turn, extend parallel to the principal pump plane 59, that is a plane intersecting the cylinders and extending normal to the cylinder plane 61. In the preferred form of the invention, the angle A is 35°.

Figure 7:
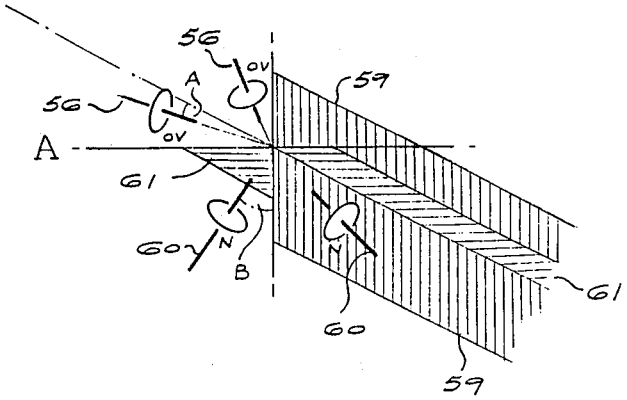
FIG. 7 is a diagram indicating the various planes referred to in the description of the pump.

In FIGS. 3 and 7 it can be seen that the inlet valves (designated by N in FIG. 7) are mounted on actuator axes 60 which extend at an angle B with respect to the cylinder plane 61. In the preferred form of the invention the angle B is −35°.

Angling of the valves in the manner described, enables the placing of the cylinders closely adjacent one another which, in turn, results in a virtually straight flow path from the cylinders 12 through the common inlet and outlet housing 18 into the discharge line 20 of the pump and has the further advantage that the valves are easily accessible and removable for maintenance purposes.

Figure 4:
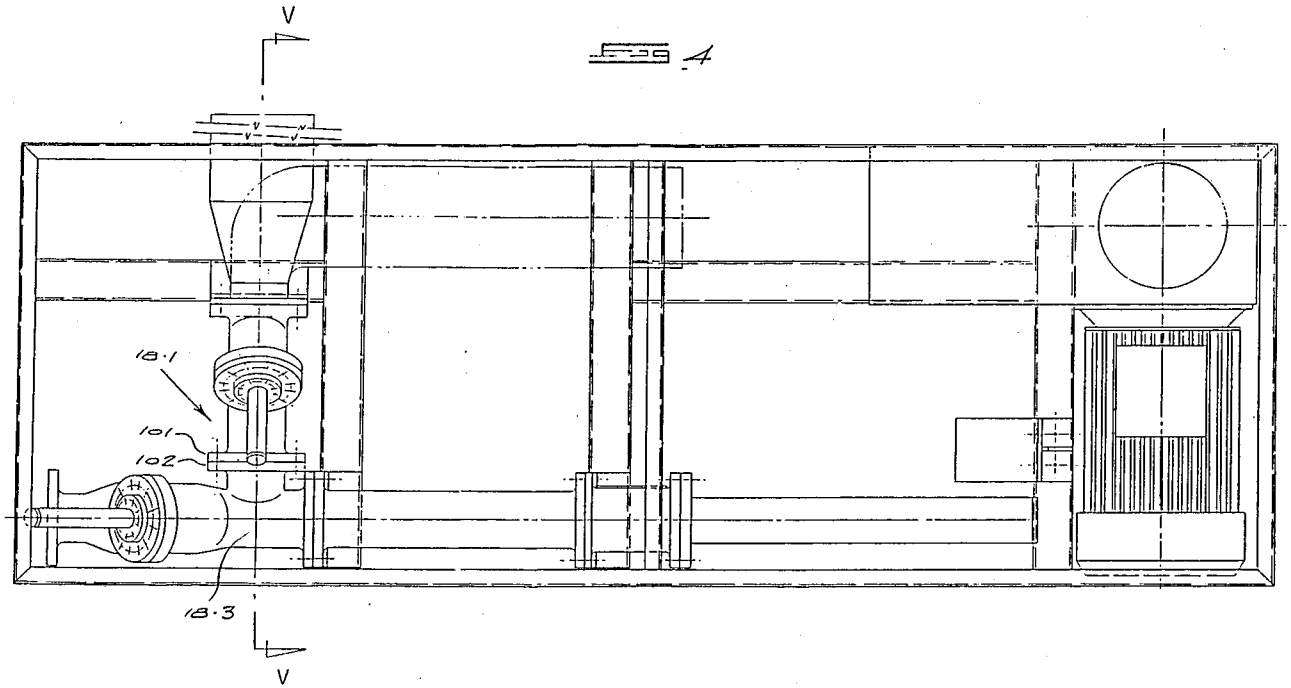
FIG. 4 is a diagrammatic side elevation of a second embodiment of the pump according to the invention.
Figure 5:
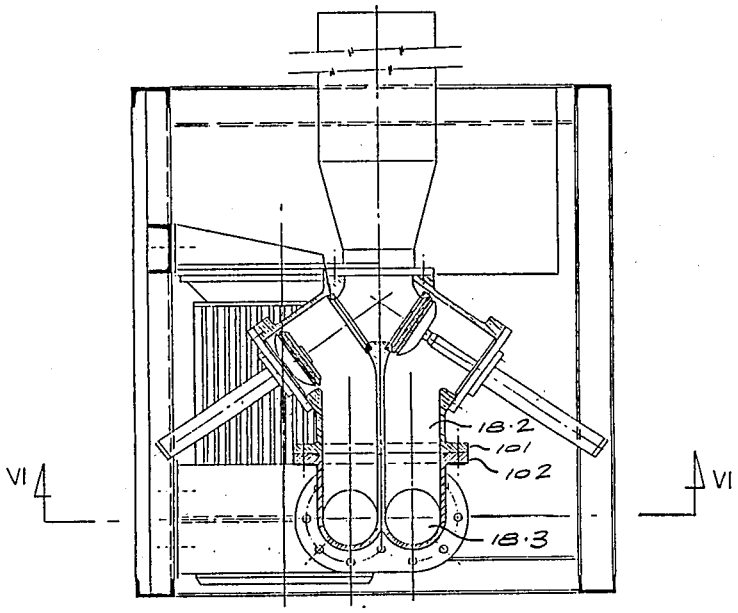
FIG. 5 is an end elevation, in section on a line V—V in FIG. 4.
Figure 6:
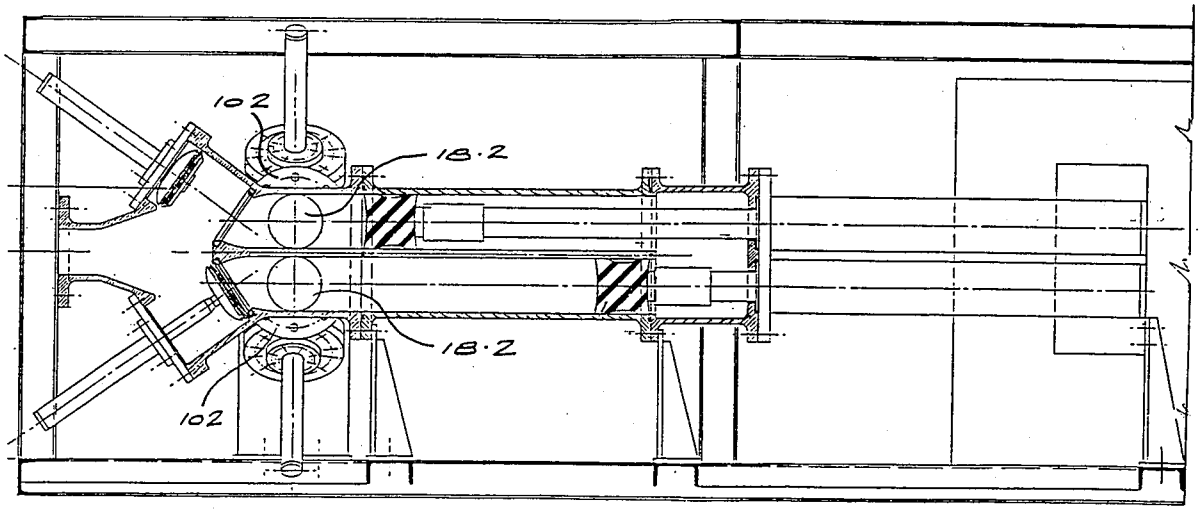
FIG. 6 is a section on a line 6—6.

The pump illustrated in FIGS. 4, 5 and 6 is similar to that described above with the exeption that the common inlet and outlet housing 18.1 is extended upwardly so that the housing is essentially divided into an inlet part 18.2 and an outlet part 18.3. The housing parts are secured to one another across a pair of mating flanges 101 and 102, so that the housing parts can be split apart for maintenance and servicing purposes. It has, for instance, been shown in tests with the pump, that the inlet part 18.2 wears a lot faster than the outlet part 18.3. Splitting the housing in the manner described above enables the replacement of the rapidly wearing inlet part without the need for replacing the entire inlet/outlet assembly.

I claim:

1. A fluid pump comprising a pair of pistons which are reciprocable in parallel cylinders opening into a common inlet and outlet housing through cylinder outlets surrounded by outlet valve seats, the housing including inlet apertures surrounded by inlet valve seats and which open into the housing, the cylinders being closable by outlet valves closing against the outlet valve seats and the inlet apertures being closable by inlet valves closing against the inlet valve seats, the outlet valve seats being angled with respect to the principal cylinder axes and the inlet valve seats being angled with respect to the cylinder plane, which is the plane extending between the cylinder centre lines.

2. A fluid pump comprising a pair of pistons which are reciprocable in parallel cylinders opening into a common inlet and outlet housing through cylinder outlets surrounded by outlet valve seats, the housing including inlet apertures surrounded by inlet valve seats and which open into the housing, the cylinders being closable by outlet valves closing against the outlet valve seats and the inlet apertures being closable by inlet valves closing against the inlet valve seats and the inlet and outlet valves operating on axes normal to the planes of the valve seats, the valve actuator axes of the outlet valves being angled with respect to the principal cylinder axes and the valve actuator axes of the inlet valves being angled with respect to the principal pump plane, which is a plane normal to the cylinder plane.

3. A pump according to claim 2 in which the outlet valve seats extend along planes normal to valve actuator axes which are angled between 0 degrees and 90 degrees to the principal axis of each cylinder.

4. A pump according to claim 2 in which the outlet valve seats extend along planes normal to valve actuator axes which are angled at an angle of 35 degrees to the principal axis of each cylinder.

5. A pump according to claim 2 in which the inlet valve seats extend along planes normal to valve actuator axes which are angled between 0 degrees and −90 degrees to the cylinder plane.

6. A pump according to claim 2 in which the inlet valve seats extend along planes normal to valve actuator axes which are angled at an angle of −35 degrees to the cylinder plane.

7. A fluid pump, comprising:

a pair of parallel cylinders;

a common inlet housing at one end of each of the cylinders;

a common outlet housing at the one end of each of the cylinders;

inlet valve seats between the common inlet housing and the respective one ends of the cylinders, each inlet valve seat being angled to a cylinder plane defined by the principle axes of the cylinders;

outlet valve seats between the common outlet housing and the respective one ends of the cylinders, each outlet valve seat being angled to the principle axes of the cylinders;

inlet valve means for respectively closing against the inlet valve seats;

outlet valves means for respectively closing against the outlet valve seats; and a pair of pistons respectively reciprocable in the cylinders.

8. The pump according to claim 7, wherein the inlet and outlet valve seats are planar and the inlet and outlet valve means operate for closing the same on axes respectively normal thereto.

9. The pump according to claim 8, wherein the angle of each of the inlet valve seats to the principle plane is from less than 0° to −90°.

10. The pump according to claim 9, wherein the angle is about −35°.

11. The pump according to claim 8, wherein the angle of each of the outlet valve seats to the respective principle axes is from more than 0° to 90°.

12. The pump according to claim 11, wherein the angle is about 35°.

13. The pump according to claim 11, wherein the angle of each of the inlet valve seats to the principle plane is from less than 0° to −90°.

14. The pump according to claim 13, wherein the angle is about −35°.

15. The pump according to claim 8, wherein the inlet valve seats are respectively angled oppositely to the cylinders plane and the outlet valve seats are respectively angled oppositely to the principle axes.

16. The pump according to claim 15, wherein the angle of each of the inlet valve seats to the principle plane is from less than 0° to −90°.

17. The pump according to claim 16, wherein the angle is about −35°.

18. The pump according to claim 15, wherein the angle of each of the outlet valve seats to the respective principle axes is from more than 0° to 90°.

19. The pump according to claim 18, wherein the angle is about 35°.

20. The pump according to claim 18, wherein the angle of each of the inlet valve seats to the principle plane is from less than 0° to −90°.

21. The pump according to claim 20, wherein the angle is about −35°.

* * * * *